US008088017B2

(12) United States Patent
Stremmel et al.

(10) Patent No.: US 8,088,017 B2
(45) Date of Patent: Jan. 3, 2012

(54) SYSTEM AND METHOD FOR ANALYZING BOWLING BALL MOTION

(75) Inventors: Neil B. Stremmel, Franklin, WI (US); Robert V. Roloff, Mukwanago, WI (US); Nick A. Siefers, Oak Creek, WI (US); Paul J. Ridenour, Waukesha, WI (US); James E. Jaryszak, Sturtevant, WI (US)

(73) Assignee: United States Bowling Congress, Inc., Austin, TX (US)

( * ) Notice: Subject to any disclaimer, the term of this patent is extended or adjusted under 35 U.S.C. 154(b) by 1030 days.

(21) Appl. No.: 11/971,403

(22) Filed: Jan. 9, 2008

(65) Prior Publication Data

US 2008/0287204 A1 Nov. 20, 2008

Related U.S. Application Data

(60) Provisional application No. 60/930,302, filed on May 15, 2007.

(51) Int. Cl.

| | |
|---|---|
| ***A63D 5/04*** | (2006.01) |
| ***A63D 1/00*** | (2006.01) |
| ***A63D 5/00*** | (2006.01) |
| ***A63D 5/02*** | (2006.01) |
| ***A63D 3/02*** | (2006.01) |
| *A63B 37/00* | (2006.01) |
| *A63B 43/00* | (2006.01) |
| *A63B 69/00* | (2006.01) |

(52) U.S. Cl. ..... 473/58; 473/54; 473/55; 473/106; 473/107; 473/109; 473/125; 434/249

(58) Field of Classification Search ..... 473/54, 473/55, 58, 106, 107, 109, 125; 434/249
See application file for complete search history.

(56) References Cited

U.S. PATENT DOCUMENTS

| | | | | |
|---|---|---|---|---|
| 4,330,123 | A | | 5/1982 | Kleinerman |
| 4,337,049 | A | | 6/1982 | Connelly |
| 4,461,478 | A | * | 7/1984 | Lee et al. ..... 473/125 |
| 4,603,861 | A | * | 8/1986 | Arnott ..... 473/125 |
| 4,659,079 | A | | 4/1987 | Blanchard |
| 4,751,642 | A | | 6/1988 | Silva et al. |
| 4,893,182 | A | | 1/1990 | Gautraud et al. |
| 5,118,105 | A | * | 6/1992 | Brim et al. ..... 473/58 |
| 5,221,088 | A | | 6/1993 | McTeigue et al. |
| 5,437,578 | A | * | 8/1995 | Wasserberger et al. ..... 473/126 |
| 5,521,393 | A | * | 5/1996 | Burkholder et al. ..... 250/559.22 |
| 5,697,791 | A | | 12/1997 | Nashner et al. |

(Continued)

*Primary Examiner* — David L Lewis
*Assistant Examiner* — William H McCulloch, Jr.
(74) *Attorney, Agent, or Firm* — Michael Best & Friedrich LLP

(57) ABSTRACT

A system and method for graphically and statistically analyzing and predicting the motion of a bowling ball. In one embodiment, the system includes an automatic precision ball thrower, a computer aided tracking system ("C.A.T.S."), and a computing device. Certain static properties of the bowling ball are recorded as independent variables. The automatic precision ball thrower is used to throw the bowling ball down the lane a number of times and the C.A.T.S. records various dynamic characteristics of its path. This data is received by the computing device which uses it to calculate a plurality of dependent variables associated with the path of the bowling ball. The computing device relates the independent variables to the dependent variables using multivariable regression analysis, yielding a set of equations which can be used to predict the dependent variables (or dynamic characteristics) of a second bowling ball given a set of independent variables (or static characteristics of the second bowling ball).

26 Claims, 10 Drawing Sheets

U.S. PATENT DOCUMENTS 5,713,798 A * 2/1998 Brodie, Jr. ..... 473/55
5,772,522 A 6/1998 Nesbit et al.
5,792,031 A 8/1998 Alton
5,811,763 A * 9/1998 O'Rorke ..... 219/411
5,826,578 A 10/1998 Curchod
5,830,073 A * 11/1998 Voss ..... 473/54
5,833,548 A * 11/1998 Ellis et al. ..... 473/125
5,842,929 A 12/1998 Moody et al.
5,857,855 A 1/1999 Katayama
6,005,548 A 12/1999 Latypov et al.
6,027,412 A * 2/2000 Pinel et al. ..... 473/126
6,032,530 A 3/2000 Hock
6,077,167 A * 6/2000 Ciniello ..... 473/54
6,110,052 A 8/2000 Sprager et al.
6,319,142 B1 * 11/2001 Ciniello ..... 473/54
6,368,228 B1 * 4/2002 Lanzetta ..... 473/111
6,379,257 B1 4/2002 Skleba et al.
6,671,971 B2 * 1/2004 Albert ..... 33/509
7,094,164 B2 8/2006 Marty et al.
7,160,200 B2 1/2007 Grober
7,257,237 B1 8/2007 Luck et al.
7,473,322 B2 * 1/2009 Hickland et al. ..... 134/6
7,837,571 B2 * 11/2010 Romagnoli et al. ..... 473/67
7,845,225 B2 * 12/2010 Ridenour et al. ..... 73/379.02
7,930,131 B2 * 4/2011 Ridenour et al. ..... 702/139
2002/0016209 A1 * 2/2002 Bates ..... 473/55
2002/0166971 A1 * 11/2002 Burns et al. ..... 250/341.8
2003/0017881 A1 * 1/2003 Speranza et al. ..... 473/52
2003/0050421 A1 * 3/2003 Salvino ..... 528/44
2004/0077818 A1 * 4/2004 Salvino ..... 528/44
2004/0209697 A1 * 10/2004 Rhodes, Jr. ..... 473/112
2004/0242292 A1 * 12/2004 Hansen ..... 463/1
2005/0011542 A1 * 1/2005 Hickland et al. ..... 134/40
2005/0014570 A1 * 1/2005 Blackstone ..... 473/58
2005/0154090 A1 * 7/2005 Salvino ..... 523/400
2005/0186999 A1 * 8/2005 Melgosa et al. ..... 463/2
2006/0189782 A1 * 8/2006 Peters et al. ..... 528/85
2007/0184908 A1 * 8/2007 Hansen ..... 463/49
2008/0287204 A1 * 11/2008 Stremmel et al. ..... 473/58
2009/0199636 A1 * 8/2009 Ridenour et al. ..... 73/379.02
2009/0204360 A1 * 8/2009 Ridenour et al. ..... 702/139
2009/0270193 A1 * 10/2009 Stremmel et al. ..... 473/55

* cited by examiner

FIG. 11

170

| Y-variable | Ball | Test Value | Predicted Value | -95% Prediction Interval | +95% Prediction Interval | Is the Test within the Prediction |
|---|---|---|---|---|---|---|
| Intended Path @ 49' | WB1 | 8.89 | 9.47 | 6.233 | 12.713 | Yes |
| | EB2 | 10.62 | 11.93 | 9.045 | 14.822 | Yes |
| Intended Path @ 60' | WB1 | 17.27 | 24.72 | 18.457 | 30.980 | No |
| | EB2 | 20.40 | 24.90 | 19.571 | 30.224 | Yes |
| Average Path @ 49' | WB1 | 9.21 | 14.29 | 9.663 | 18.910 | No |
| | EB2 | 11.09 | 13.84 | 9.722 | 17.963 | Yes |
| Average Path @ 60' | WB1 | 17.31 | 25.14 | 18.408 | 30.879 | No |
| | EB2 | 20.45 | 25.21 | 19.475 | 30.934 | Yes |
| Velocity Dec @ 49' | WB1 | 2.01 | 2.22 | 1.742 | 2.706 | Yes |
| | EB2 | 1.88 | 2.11 | 1.669 | 2.555 | Yes |
| Velocity Dec @ 60' | WB1 | 2.68 | 3.31 | 2.269 | 4.343 | Yes |
| | EB2 | 2.65 | 2.94 | 1.980 | 3.902 | Yes |
| Ang Dec @ 49' | WB1 | 3.56 | 4.24 | 2.880 | 5.602 | Yes |
| | EB2 | 4.06 | 3.97 | 2.702 | 5.245 | Yes |
| Ang Dec @ 60' | WB1 | 4.51 | 4.70 | 2.886 | 6.507 | Yes |
| | EB2 | 5.20 | 4.52 | 3.020 | 6.014 | Yes |

SYSTEM AND METHOD FOR ANALYZING BOWLING BALL MOTION

RELATED APPLICATIONS

This application claims the benefit of prior filed U.S. provisional patent application Ser. No. 60/930,302 filed on May 15, 2007, the entire contents of which are hereby incorporated by reference.

BACKGROUND

The present invention relates to systems that analyze and predict the motion of a bowling ball.

It is generally understood that to improve the opportunity for bowling a strike in the game of bowling, a bowling ball should be thrown so that the ball contacts the pins in the pocket between the headpin and the adjacent pin (i.e., the 1-3 pocket for right-handed bowlers and the 1-2 pocket for left-handed bowlers). Further improvements can be made by providing rotation to the ball so that the ball curves and contacts the pocket at an angle relative to the longitudinal axis of the bowling lane.

Many factors affect the position and direction of the bowling ball when it strikes the pins. For example, the ball's rotational speed, rotational axis, angle of delivery, frictional characteristics, and velocity all affect its motion as it travels down the lane. In addition, certain properties of the bowling ball, including its diameter and coverstock type, affect the bowling ball's path.

SUMMARY

The large numbers of variables that influence the motion of a bowling ball make it very difficult to develop a system that can accurately predict the behavior of a bowling ball. As a result, it can be difficult for bowling ball manufacturers and testers to predict the way that a bowling ball will behave without causing it to be thrown down a bowling lane. This process of testing the behavior of a bowling ball can be expensive and time consuming. Therefore, it would be useful to have a system that is capable of accurately predicting the path of a bowling ball based on the physical characteristics of the ball, without having to throw it down the lane.

One embodiment of the invention provides a system for graphically and statistically analyzing and predicting the motion of a bowling ball that is thrown down a lane. The system includes an automatic precision ball thrower, a computer aided tracking system ("C.A.T.S."), and a computing device. The C.A.T.S. uses a bowling lane, bowling pins, a bowling ball, and a number of sensors suitable for recording the path, velocity, spin, and angle of the bowling ball as it travels down the lane. Prior to throwing the bowling ball down the lane, certain properties of the bowling ball are recorded on the computing device as independent variables, including the ball's surface roughness, the oil absorption rate, and the radius of gyration (static characteristics). The automatic precision ball thrower is used to throw the bowling ball down the lane a number of times and the C.A.T.S. records various characteristics of its path (dynamic characteristics). This data is received by the computing device which uses it to calculate an average ball path. The computing device uses the average ball path and regression lines to calculate 20 dependent variables associated with the path of the bowling ball. The computing device then relates the independent variables to the dependent variables using a multivariable regression analysis. This multivariable regression analysis yields a set of equations which can be used to predict the dependent variables given a set of independent variables of a different bowling ball. Thus, for any given set of bowling ball properties, certain characteristics of the bowling ball's path can be predicted.

In another embodiment, a method for analyzing and predicting the path of a bowling ball is provided. The method includes determining a plurality of physical characteristics for a first bowling ball. The plurality of physical characteristics includes an on-lane coefficient of friction, a dry lane coefficient of friction, an oil absorption rate, a radius of gyration, a surface roughness, a total differential, an intermediate differential, a spin time, a diameter, a room temperature, a side weight, an oil volume at 8 feet, 32 feet, and 51 feet, a finger/thumb weight, a room humidity, a top weight, a lane temperature, a ratio of differentials, a coverstock type, a coefficient of restitution, and a radius of gyration about a positive axis point. The method also includes determining a plurality of dynamic attributes of the first bowling ball by repeatedly throwing the first bowling ball down a bowling lane, and monitoring the motion of the first bowling ball during each throw using a plurality of sensors. Monitoring of the first bowling ball includes monitoring a skid phase, a hook phase, and a roll or back-end phase of the first bowling ball. A path of motion, spin rate, and velocity of the first bowling ball as it travels down the bowling lane is determined. A relationship between the plurality of physical characteristics of the first bowling ball and the plurality of dynamic attributes of the first bowling ball is determined using a multivariable regression.

In yet another embodiment, the invention provides a computer system for predicting the motion of a test bowling ball. The system includes a programmed processor configured to receive input data regarding the physical characteristics of the test bowling ball. The physical characteristics of the test bowling ball include an on-lane coefficient of friction, a dry lane coefficient of friction, an oil absorption rate, a radius of gyration, a surface roughness, a total differential, an intermediate differential, a spin time, a diameter, a room temperature, a side weight, an oil volume at 8 feet, 32 feet, and 51 feet, a finger/thumb weight, a room humidity, a top weight, a lane temperature, a ratio of differentials, a coverstock type, a coefficient of restitution, and a radius of gyration about a positive axis point. The programmed processor includes a path-predicting module configured to generate a predicted path of the test bowling ball based on a relationship between a predetermined plurality of dynamic attributes of at least a second bowling ball and a predetermined plurality of physical characteristics of the second bowling ball. A regression analysis is performed to determine the relationship between the static characteristics and the dynamic attributes, and the relationship is stored in a memory accessible by the programmed processor.

In additional embodiments, subsets of the physical characteristics are used for predicting the motion of the bowling ball. The subsets are determined by analyzing the relative effect that each physical characteristic has on the motion of the bowling ball. The physical characteristics include an on-lane coefficient of friction, a dry lane coefficient of friction, an oil absorption rate, a radius of gyration, a surface roughness, a total differential, an intermediate differential, a spin time, a diameter, a room temperature, a side weight, an oil volume at 8 feet, 32 feet, and 51 feet, a finger/thumb weight, a room humidity, a top weight, a lane temperature, a ratio of differentials, a coverstock type, a coefficient of restitution, and a radius of gyration about a positive axis point. Each of the physical characteristics is recorded for each bowling ball tested. The bowling balls are thrown down a bowling lane a plurality of times. Each bowling ball is monitored as it travels down the bowling lane and a set of dynamic attributes is calculated from the motion of the bowling ball. The dynamic attributes include intended path at 49 feet, intended path at 60 feet, average path at 49 feet, average path at 60 feet, velocity decrease between 11 and 49 feet, velocity decrease between 11 and 60 feet, change of angle at 49 feet, change of angle at 60 feet, first transition point, second transition point, negative slope, positive slope, total angle, total hook length, angle per foot, "A" value, breakpoint, first transition to breakpoint length, breakpoint to second transition length, and frictional efficiency. After each dynamic attribute has been recorded, a best subsets regression is performed to determine which of the physical characteristics have the greatest influence on each of the dynamic variables. Based on the results from the best subsets regression, a set of ball-motion equations is computed that predicts the motion of the bowling ball as it travels down bowling lane. The ball-motion equations are used to determine which of the physical characteristics have the greatest effect on bowling ball motion. The physical characteristics that have the greatest influence on the bowling ball's motion can then be used as a subset of physical characteristics to more efficiently predict the motion of the bowling ball. For example, in some embodiments, a subset of six physical characteristics is used to predict the motion of the bowling ball.

Other embodiments, features, and aspects of the invention will become apparent from the drawings and detailed description.

BRIEF DESCRIPTION OF THE DRAWINGS

FIG. 11 illustrates ball-motion prediction results based on a set of ball-motion equations.

DETAILED DESCRIPTION

Figure 1:
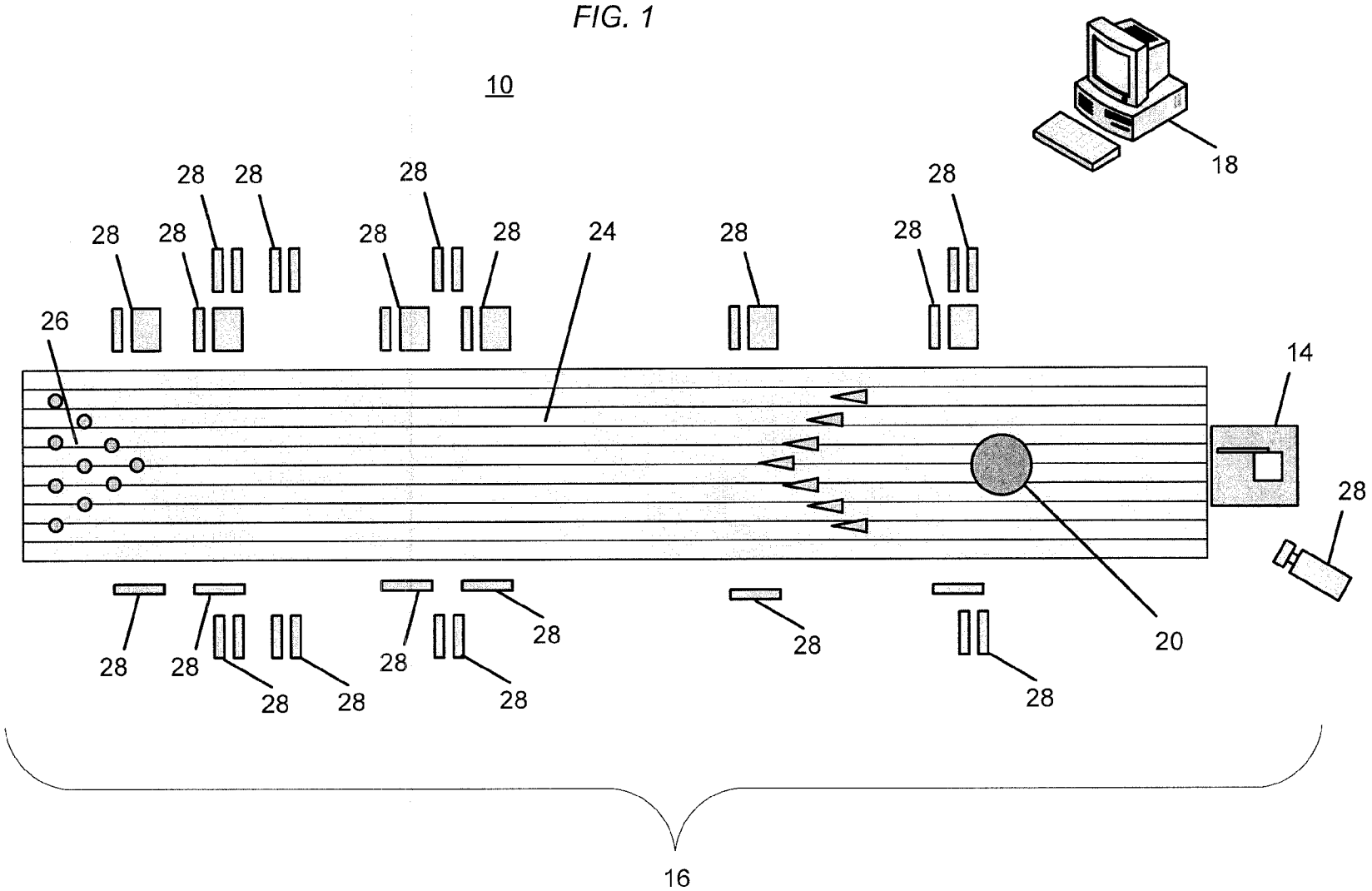
FIG. 1 illustrates a schematic representation of one embodiment of the invention.

Before any embodiments of the invention are explained in detail, it is to be understood that the invention is not limited in its application to the details of construction and the arrangement of components set forth in the following description or illustrated in the drawings. The invention is capable of other embodiments and of being practiced or of being carried out in various ways.

Certain embodiments of the invention provide a system which uses a set of tools to graphically and statistically analyze and predict the motion of a bowling ball. FIG. 1 depicts a system 10, which includes an automatic precision ball thrower 14, a computer aided tracking system (C.A.T.S.) 16, and a computing device 18. The automatic precision ball thrower 14 is configured to consistently throw a bowling ball 20 down a bowling lane 24. The automatic ball thrower 14 can be configured to throw the bowling ball 20 using consistent ball rotational speed, rotational axis, angle of delivery, loft, and velocity, which are parameters that affect a bowling ball's 20 path. An example of an automatic precision ball thrower 14 is disclosed in U.S. Pat. No. 6,379,257, the teachings and descriptions of which are incorporated herein by reference as though set forth in fall.

The C.A.T.S. 16 is used to analyze the bowling ball 20 as it travels down the lane 24 and provide feedback regarding various parameters. The C.A.T.S. 16 may include a lane 24, pins 26 positioned on one end of the lane 24, a bowling ball 20 adapted to be thrown down the lane 24 as well as detectors 28 for determining the spin rate, the velocity, and the launch and entry angles of the bowling ball 20. In the illustrated embodiment, the C.A.T.S. 16 includes 10 sensors. In other embodiments, the C.A.T.S. 16 may include a lesser or greater number of sensors depending on the amount of information concerning the bowling ball's motion that is desired. In addition, in the illustrated embodiment, the sensors include optical devices designed to measure the velocity and position of the bowling ball 20 as it travels down the lane 24 and cameras positioned at one end of the lane 24 to capture images of the bowling ball 20. An example of a C.A.T.S. 16 is disclosed in U.S. Pat. No. 6,110,052, the teachings and descriptions of which are incorporated herein by reference as though set forth in full.

The computing device 18 is configured to receive data from the user or from other devices (not shown) in the form of certain independent variables as described below. In addition, the computing device 18 is configured to receive data (from the user, from the C.A.T.S. 16, or both) which can be used to determine certain dependent variables as described below. The computing device 18 is also configured to perform certain computations such as calculating the average path of a bowling ball 20 from a plurality of bowling ball paths. The computing device 18 may also be configured to determine a relationship between the independent variables and the dependent variables using a multivariable regression analysis described below. The computing device 18 may be a personal computer, a laptop, or any other device suitable for storing data and performing computations.

Other embodiments of the invention provide a method suitable for analyzing and predicting the path of a bowling ball 20. In one example, the method includes recording twenty-three physical properties of the bowling ball 20 as independent variables before the ball is thrown down the lane. In one embodiment, these independent variables are input by the user certain devices designed specifically for measuring the characteristics of the bowling ball into the computing device 18. Each of the twenty-three physical characteristics is recorded for each bowling ball tested. The bowling balls are thrown down a bowling lane a plurality of times. Each bowling ball is monitored as it travels down the bowling lane and a plurality of dynamic attributes (described in detail below) is calculated from the motion of the bowling ball 20. After each dynamic attribute has been recorded, a best subsets regression is performed to determine which of the physical characteristics have the greatest influence on each of the dynamic variables. Based on the results from the best subsets regression, a set of ball-motion equations is computed. The ball-motion equations are then used to determine which of the physical characteristics have the greatest effect on bowling ball motion. In some embodiments, a subset of the twenty-three physical characteristics used during the initial analysis is used to predict the motion of the bowling ball 20. For example, the six or eighteen physical characteristics with the greatest influence are used to predict the motion of the bowling ball 20. A reduction in the number of physical characteristics used to predict bowling ball motion increases the efficiency of the analysis of the bowling ball 20 and reduces the time required to predict the bowling ball 20's motion. Each of the twenty-three independent variables are listed and described in more detail below:

1. Surface Roughness-Ra
2. On-lane Coefficient of Friction
3. Surface Roughness-RS
4. Dry-Lane Coefficient of Friction
5. Oil Absorption Rate
6. Radius of Gyration
7. Total Differential
8. Spin Time
9. Diameter
10. Side Weight
11. Intermediate Differential
12. Average Oil Volume at 32 feet
13. Room Humidity
14. Average Oil Volume at 8 feet
15. Top Weight
16. Room Temperature
17. Thumb Weight
18. Lane Temperature
19. Ratio of Differentials
20. Average Oil Volume at 51 feet
21. Coverstock Type
22. Coefficient of Restitution
23. Radius of Gyration about a PAP The Surface Roughness-Ra is the height of the "spikes" on the bowling ball 20's surface. A surface roughness measurement tool measures irregularities on the surface of the bowling ball 20. The height of the "spikes" on the surface of the bowling ball 20 is determined from a vertical displacement of the surface roughness measurement tool as it traverses the surface of the bowling ball 20. In some embodiments, a total of ten measurements are recorded using the surface roughness measurement tool from four different segments of the bowling ball 20. An average of the ten readings is calculated to determine the Surface Roughness-Ra of the bowling ball 20.

The On-Lane Coefficient of Friction is a calculation of the coefficient of friction encountered by the bowling ball 20 between, for example, 11 feet and 38 feet while rolling down the bowling lane 24. In additional embodiments, the On-Lane Coefficient of Friction is defined for different distances.

The Surface Roughness-RS is the distance between the spikes on a bowling ball 20's surface. The surface roughness measurement tool described above with respect to the Surface Roughness-Ra is used to calculate the arithmetic mean of peak-to-peak distances of the "spikes" on the bowling ball 20. The measurement is calculated from the average of one reading across four segments of the bowling ball 20. In additional embodiments, more readings are taken across more or fewer segments of the bowling ball 20.

The Dry-Lane Coefficient of Friction is derived by measuring the amount of force required to move the bowling ball 20, without rolling it, over the surface of the dry (un-oiled) lane 24. In other words, the Dry-Lane Coefficient of Friction is derived by measuring the amount of force that is needed to cause the bowling ball 20 to be pulled across a dry (un-oiled) lane 24. This procedure is described in more detail in Appendix F of the USBC Equipment Specifications Manual, available at http://www.bowl.com/specs/manual.aspx. The methodologies used to derive this value are well understood by those who are skilled in the art of bowling ball manufacture and testing and will not be further described herein.

The Oil Absorption Rate for the bowling ball 20 is derived by measuring the amount of time the bowling ball 20 takes to absorb a single drop (approximately 0.5 μL) of oil. This value is determined by applying oil to a single area on the surface of the bowling ball 20 and waiting for the oil to be fully absorbed. The diameter of the drop of oil is measured in two directions using a micrometer to determine the surface area of the drop. The time required for the oil to be completely absorbed is recorded. In some embodiments, the maximum amount of time allowed for the oil to be absorbed is 30 minutes. The process described above is repeated four times and an average value of the times is calculated. The oil absorption rate for the bowling ball 20 is calculated from the surface area, amount of oil in the drop, and the time for complete absorption of the oil.

The Radius of Gyration (RG) is a measurement of where the weight is located inside of the bowling ball 20 relative to its center. It is defined as the square root of the bowling ball 20's moment of inertia divided by its mass. The Radius of Gyration is a measurement of how easy it is for the bowling ball 20 to resist rotation. A procedure for measuring the Radius of Gyration is described in detail in Appendix D of the USBC Equipment Specifications Manual, available at http://www.bowl.com/specs/manual.aspx.

Every bowling ball has a high RG axis, a low RG axis, and an intermediate RG axis. The relation of these axes helps to give a bowling ball 20 a preferred axis of rotation such that when the bowling ball 20 is thrown, it will try to migrate to its preferred axis of rotation as it rolls down the lane. The Total Differential of the bowling ball 20 is the difference between the RG values for the high RG axis and the low RG axis. The Intermediate Differential of the bowling ball is the difference between the RG values for the high RG axis and the intermediate RG axis. The Ratio of Differentials is the ratio of the Total Differential to the Intermediate Differential. The methodologies for determining the Radius of Gyration as well as the RG values for the high, intermediate, and low RG axes are understood by those with skill in the art of bowling ball manufacture and testing.

The Spin Time of the bowling ball 20 is the average time that it takes the spinning bowling ball 20 to migrate to its high RG axis. This value is generally measured by placing the bowling ball 20 on a spinning device, in a certain orientation, and measuring the amount of time that it takes for the bowling ball 20 to migrate to its high RG axis.

The Diameter is an average diameter of the bowling ball 20. The bowling ball 20's surface is rough, which results in a variance in the diameter of the bowling ball 20. An Abralon® sanding process is used to smooth the surface of the bowling ball 20, and as a result, the diameter of the bowling ball 20 changes. After the Abralon® process is completed, a set of diameter measurements are taken and an average diameter value is calculated.

The Top Weight is the difference in weight between the top half of the ball and the bottom half of the ball. The Side Weight is the difference in weight between the left side of the midline of the grip and the right side of the midline of the grip.

The Average Oil Volume at 8 feet, 32 feet, and 51 feet are the average amounts of oil present across a flat pattern at 8 feet, 32 feet, and 51 feet, respectively, on the bowling lane 24. These measurements may be made using a commercially available device (e.g., a Brunswick Computer Lane Monitor).

In some embodiments, the type of bowling lane oil is varied. Results of the bowling ball 20's path are then compared for the different lane oils.

The Lane Temperature is the temperature of the bowling lane 24 at its surface when the analysis is being performed. The Room Temperature is the ambient air temperature in the room where the analysis is being performed. The Room Humidity is the ambient air humidity in the room where the analysis is being performed.

The Thumb Weight is the difference in weight between the thumb side of the midline of the grip and the finger side of the midline of the grip.

A coverstock is the shell of a bowling ball 20 which is in direct contact with the bowling lane 24's surface and oil when the bowling ball 20 is thrown. The Coverstock Type relates to the material composition of the coverstock. The most common coverstock types are: polyester, urethane, reactive urethane, and particle.

The Coefficient of Restitution is related to the elasticity of the surface of the bowling ball 20 and is a ratio of the energy transferred from the bowling ball 20 to a standard bowling pin.

The Radius of Gyration about a Positive Axis Point (PAP) is the radius of gyration reading about the positive axis point of an automatic-precision ball thrower.

It has been found through analysis that some physical characteristics have a greater influence on the motion of the bowling ball 20 than others. As a result, in some embodiments of the invention, physical characteristics such as Coverstock Type, Coefficient of Restitution, and Radius of Gyration about a PAP are not included in the analysis of the motion of the bowling ball 20. Additionally, a physical characteristic such as the Ratio of Differentials is simply a ratio of two other physical characteristics and may be excluded from the analysis. In some embodiments, additional independent variables are used to analyze and predict the path of the bowling ball 20.

Figure 2:
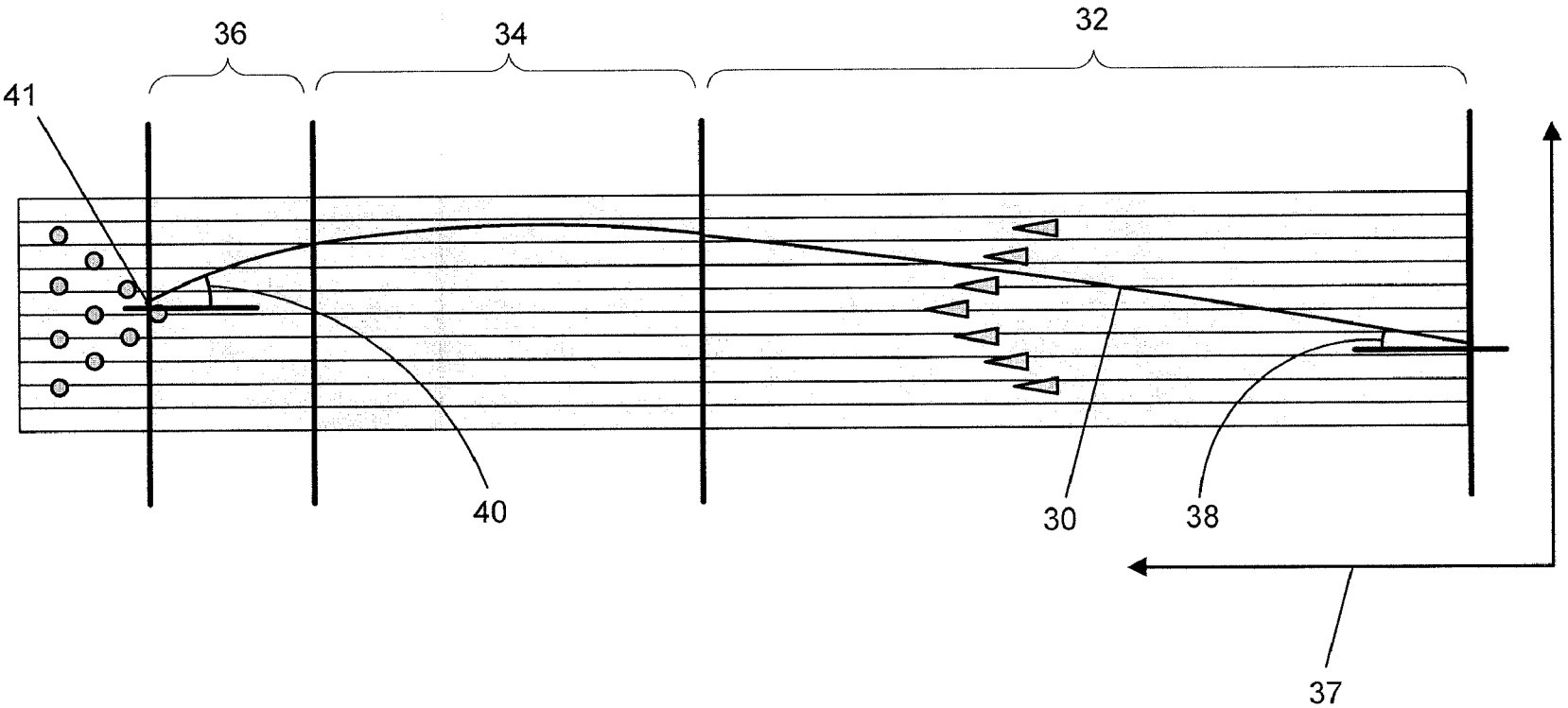
FIG. 2 illustrates a top view of a bowling lane depicting various components of the path of a bowling ball.

Testing a bowling ball may be accomplished by causing the automatic precision ball thrower 14 to throw the bowling ball 20 down the lane 24 a plurality of times while the C.A.T.S. 16 records various characteristics of the bowling ball's 20 motion as it rolls down the lane 24. As depicted in FIG. 1, the automatic precision ball thrower 14 is positioned at the front of the lane 24 so that it can throw the bowling ball 20 with a predetermined ball rotational speed, rotational axis, angle of delivery, loft, and velocity. The precision automatic ball thrower 14 launches the ball 20 down the lane 24 a number of times while the C.A.T.S. 16 records the data. This information is input into the computing device 18 for each throw of the bowling ball 20. As depicted in FIG. 2, the computing device uses this data to generate certain characteristics of these throws, including an average ball path 30, the skid phase 32, hook phase 34, and back-end phase 36 of the average ball path 30, and the launch angle 38 and entry angle 40 of the bowling ball 20. In one embodiment, this is accomplished by causing the data received from the C.A.T.S. 16 to be loaded into software running on the computing device 18 (e.g., such as Microsoft Excel) and using the software to manually manipulate the data to generate these characteristics. In other embodiments, specialized software may be developed to automatically load and manipulate the data to generate these characteristics. For convenience in describing the position of the bowling ball 20 as it travels down the lane 24, FIG. 2 depicts a set of coordinate axes 37. These coordinate axes are arranged such that the position of the bowling ball can be described in terms of a horizontal axis of the lane (representing the distance in feet that the bowling ball 20 has traveled down the lane) and a vertical axis of the lane (the bowling ball's position relative to the sides of the lane 24).

The average ball path 30 is determined by calculating the position of the bowling ball 20, for each throw, at each point on the horizontal axis of the lane 24. In other words, at each point along the horizontal axes of the lane 24, an average position of the bowling ball 20 on the vertical axis of the lane 24 is determined by calculating the average position of the bowling ball 20 on the vertical axis of the lane 24 for each throw recorded by the C.A.T.S. 16. The result is a group of coordinates that make up the average ball path 30. The average ball path extends from the beginning of the lane to the pocket 40, which is the area between the 1 and 2 pin for a right handed bowler.

FIG. 2 depicts the three phases of the average ball path 30. A bowling ball 20 that travels down a bowling lane 24 progresses through three phases. The first phase is the skid phase 32. The skid phase 32, begins when the bowling ball 20 is launched down the oiled lane 24 at a certain velocity and with a certain type and amount of spin. During the skid phase, the bowling ball 20 skids or slides across the top of the lane in a straight line, because the oiled lane 24 is slick and there is not enough friction between the bowling ball 20 and the lane 24.

The second phase of the average ball path 30 is the hook phase 34. During the hook phase 34 the combination of the friction between the bowling ball 20 and the lane 24 and the force and spin imparted upon the bowling ball 20 when it was thrown alter the path of the bowing ball 20. The hook phase 34 is often characterized by an arcing or curving of the bowling ball's 20 path.

The third phase of the average ball path 30 is the roll or back-end phase 36. During the back-end phase 36, the combination of friction between the bowling ball 20 and the lane 24 as well as the force and spin imparted upon the bowling ball 20 when it was launched cause its path to straighten until it collides with the pins 26.

In addition, each throw of the bowling ball 20 defines two angles. The first is the launch angle 38 which is the angle formed by the linear skid phase 32 and a line that is parallel to the horizontal axis of the lane 24. The second angle is the entry angle 40 which is the angle formed by the linear back-end phase 36 and a line that is parallel to the horizontal axis of the lane 24.

Figure 3:
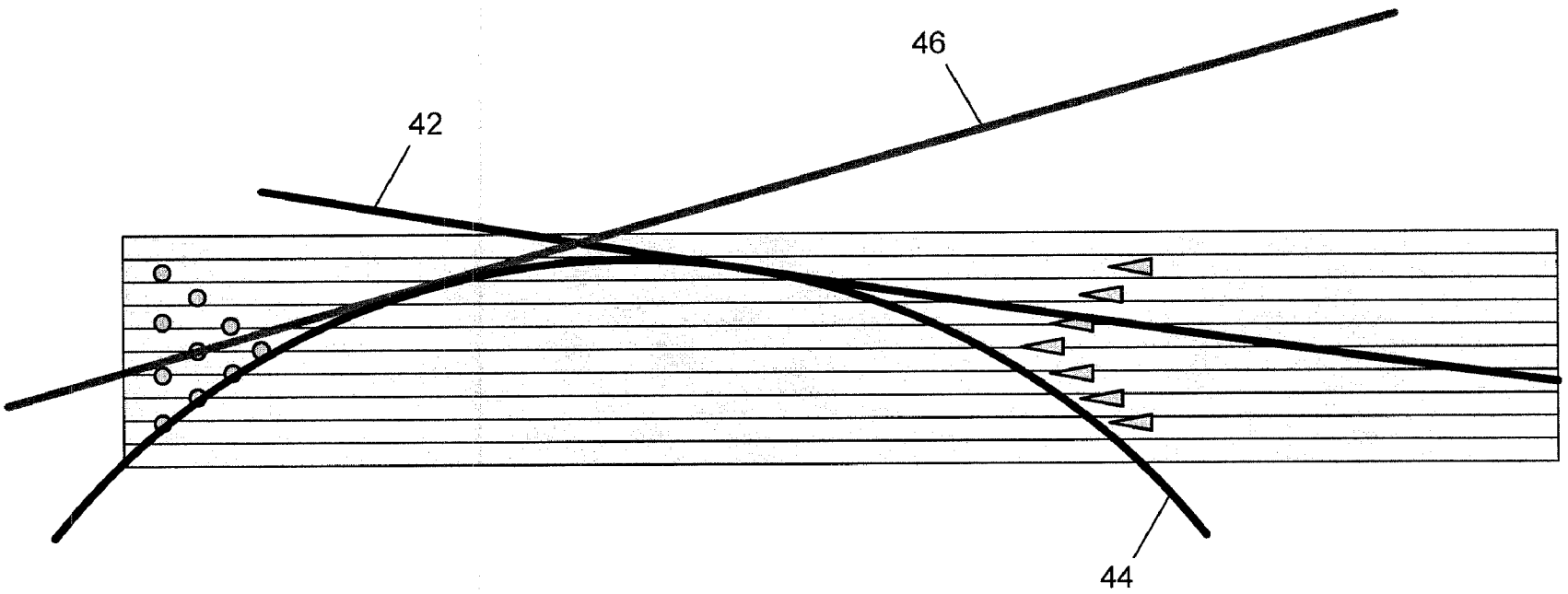
FIG. 3 illustrates a top view of a bowling lane depicting regression lines based on the path of the bowling ball shown in FIG. 2.

The computing device 18 generates three separate regression lines based on the average ball path 30 during each of the three phases. FIG. 3 depicts these regression lines, identified as the skid phase regression line 42, the hook phase regression line 44, and the back-end phase regression line 46. The skid phase regression line 42, is generated by extending the path of the bowling ball 20 during the skid phase 32, for the length of the lane 24. As depicted in FIG. 3, the skid phase regression line 42 is a straight line that extends the length of the lane at an angle equal to the launch angle 38.

The hook phase regression line 44 is generated by extending the length of the curve formed by the path of the bowling ball 20 during the hook phase 34. Thus, the hook phase regression line 44 is a curved line and can be fitted with a polynomial equation of the form $f(x)=Ax^2+Bx+C$.

The back-end phase regression line 46 is generated by extending the path of the bowling ball 20 during the back-end phase 36, for the length of the lane 24. As depicted in FIG. 3, the back-end phase regression line 46 is a straight line that extends the length of the lane at an angle equal to the entry angle 40.

Using these three regression lines as well as the other data collected by the C.A.T.S. 16, the computing device 18 is able to determine certain dependent variables. In the current embodiment, the computing device generates 20 dependent variables. However, in other embodiments the computing device may generate more dependent variables or fewer dependent variables. The 20 dependent variables of one embodiment are listed and described below:

1. Intended Path At 49 Feet
2. Intended Path At 60 Feet
3. Average Path At 49 Feet
4. Average Path At 60 Feet
5. Velocity Decrease Between 11 and 49 Feet
6. Velocity Decrease Between 11 and 60 Feet
7. Change Of Angle At 49 Feet
8. Change of Angle At 60 Feet
9. First Transition Point
10. Second Transition Point
11. Negative Slope
12. Positive Slope
13. Total Angle
14. Total Hook Length
15. Angle Per Foot
16. "A" Value
17. Breakpoint
18. First Transition To Breakpoint length
19. Breakpoint to Second Transition Length
20. Frictional Efficiency The Intended Path at 49 Feet is calculated using the hook phase regression line 44 and the skid phase regression line 42. The location of a bowling ball that is traveling on each of these lines is determined at a position which is 49 feet down the lane 24. The Intended Path at 49 Feet is a location on the lane 24 with a horizontal component of 49 feet and a vertical component that is equal to the difference between the vertical component of the bowling ball 20 that is traveling on the hook phase regression line 44 at a position that is 49 feet down the lane and the vertical component of the bowling ball 20 that is traveling on the skid phase regression line 42 at a point that is 49 feet down the lane.

The Intended Path at 60 Feet is the same as the Intended Path at 49 Feet, but calculated at a position that is 60 feet down the lane 24.

The Average Path at 49 Feet is calculated using the average ball path 30 and the skid phase regression line 42. The location of a bowling ball that is traveling along the average ball path 30 and the skid phase regression line 42 is determined at a position which is 49 feet down the lane 24. The Average Path at 49 Feet is a position on the lane 24 with a horizontal component of 49 feet and a vertical component that is equal to the difference between the vertical component of the bowling ball 20 that is traveling on average ball path 30 and the vertical component of the bowling ball 20 that is traveling on the skid phase regression line 46.

The Average Path at 60 Feet is similar to the Average Path at 49 Feet, but calculated at a position that is 60 feet down the lane 24.

The Velocity Decrease Between 11 and 49 Feet is measured by calculating the difference between the average velocity of the bowling ball 20 after it has traveled 11 feet down the lane 24 and the average velocity of the bowling ball 20 after it has traveled 49 feet down the bowling lane 24.

The Velocity Decrease Between 11 and 60 Feet is measured by calculating the difference between the average velocity of the bowling ball 20 after it has traveled 11 feet down the bowling lane and the average velocity of the bowling ball 20 after it has traveled 60 feet down the bowling lane 24.

The Change of Angle at 49 Feet is the difference between two angles. The first angle is formed by drawing a line from a point on the average ball path 30 that is 49 feet down the lane 24 to the pocket 41, and determining the angle of this line with respect to the horizontal axis of the lane 24. The second angle is the launch angle 38.

The Change of Angle at 60 Feet is the difference between two angles. The first angle is formed by drawing a line from a point on the average ball path 30 that is 49 feet down the lane 24 to the pocket 41, and determining the angle of this line with respect to the horizontal axis of the lane 24. The second angle is the launch angle 38.

The First Transition Point is the distance down the lane 24 where the hook phase 34 of the average ball path 30 begins. The Second Transition Point is the distance down the lane 24 where the back-end phase 36 of the average ball path 30 begins.

The Negative Slope is the slope of the skid phase regression line 42 and the Positive Slope is the slope of the back-end phase regression line 46. The Total Hook Length is the length of the hook phase 34 of the average ball path 30.

Angle Per Foot is the change in angle of the average ball path 30 during the hook phase 34 relative to the vertical per foot of the hook phase 34 of the average ball path 30.

The "A" Score is the coefficient of the binomial term of the polynomial equation that defines the hook phase regression line 44 for the average ball path 30. By way of illustration, if the polynomial equation for the hook phase regression line 44 is $f(x)=Ax^2+Bx+C$, the "A" Score is the value of the variable A.

The Breakpoint is the position on the lane 24 of the apex of the hook phase 34 of the average ball path 34.

The First Transition to Breakpoint Length is the distance between the First Transition Point and the Breakpoint. The Breakpoint to Second Transition Length is the distance in feet from the Breakpoint to the Second Transition Point.

The Frictional Efficiency is a ratio of a change in velocity of the bowling ball 20 over a distance the bowling ball 20 travels down the bowling lane. For example, in one embodiment, the Frictional Efficiency is a ratio of the change in velocity of the bowling ball 20 from release to 51 feet down the bowling lane over a distance of 51 feet. In other embodiments, different distances are used.

Figure 4:
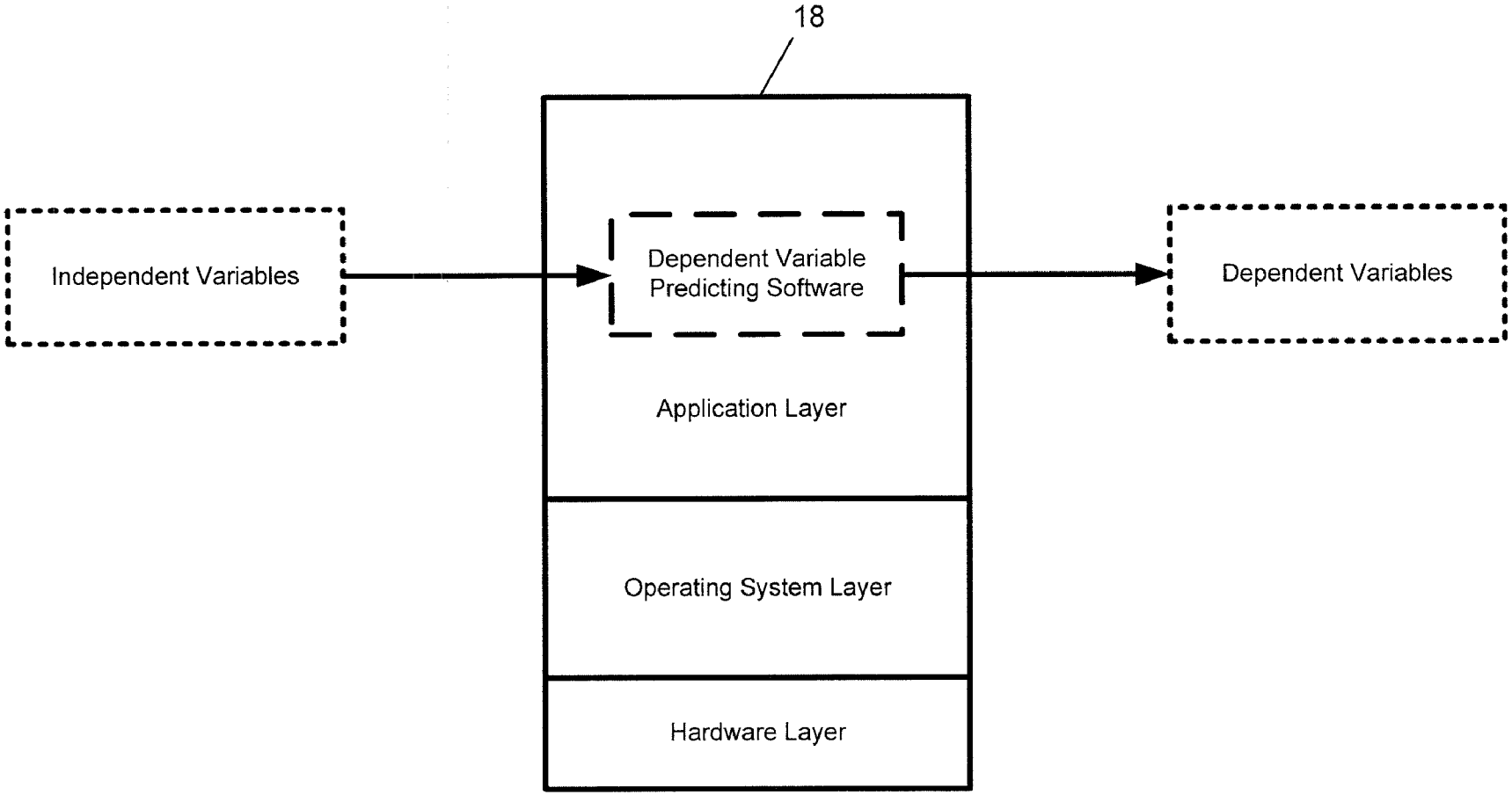
FIG. 4 illustrates a schematic representation of a computing device according to one embodiment of the invention.

After each of the 20 dependent variables is determined, the computing device 18 determines a relationship between the independent variables and the dependent variables using a multivariable regression analysis. This multivariable regression analysis allows a mathematical relationship (i.e. the ball-motion equations) between the independent variables and each dependent variable to be determined such that the dependent variables may be determined if independent variable properties of the bowling ball are known. Thus, as depicted in FIG. 4, the dependent variables of a given bowling ball can be accurately predicted without throwing the bowling ball down the lane by using software which accepts the bowling ball's independent variables and determines the dependent variables using the ball-motion equations.

Figure 5:
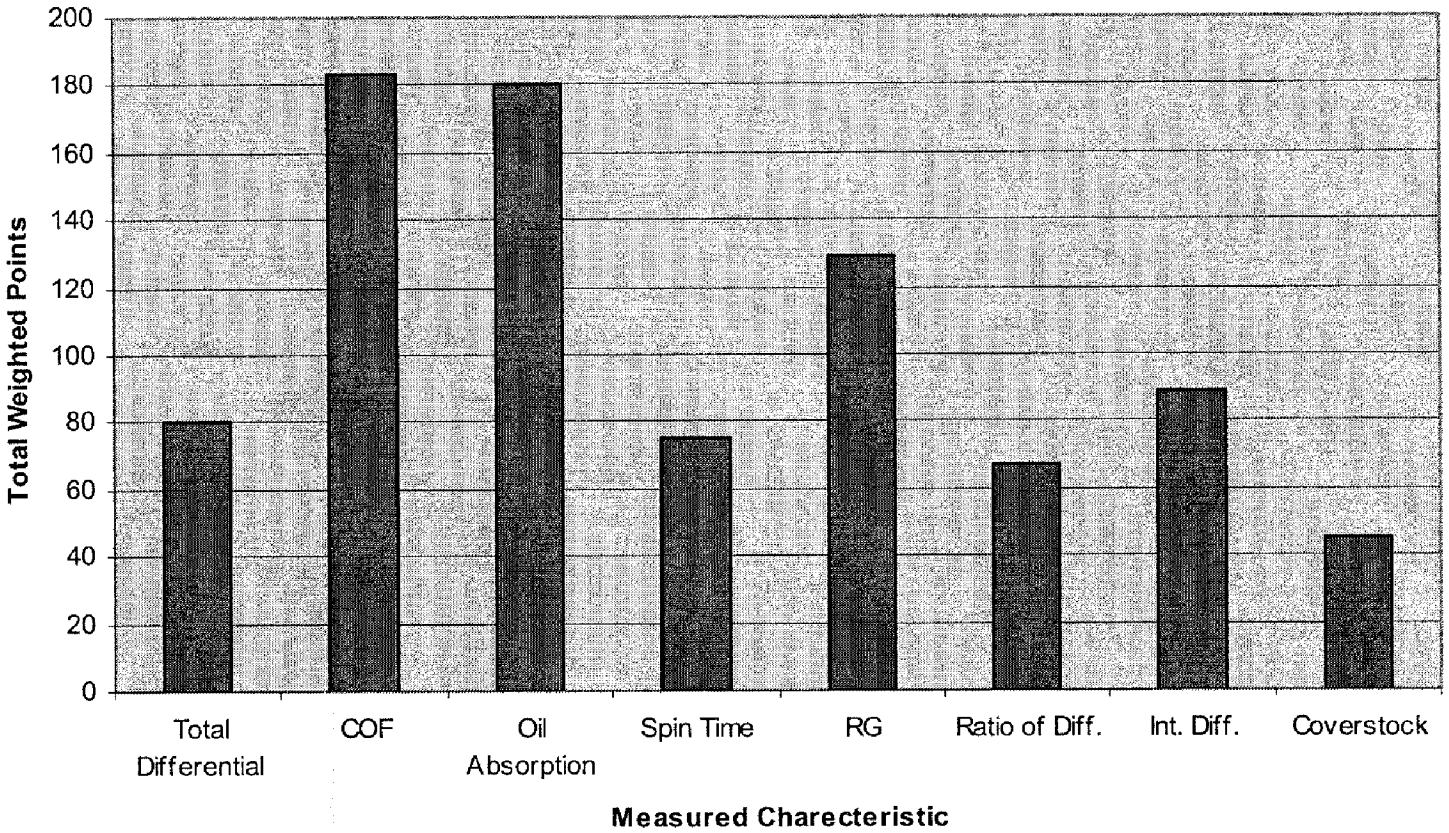
FIG. 5 illustrates a relative influence on the motion of a bowling ball for each independent variable in a set of independent variables.

FIG. 5 illustrates a chart 100 of the relationship between a set of physical characteristics and ball motion using the ball-motion equations. FIG. 5 demonstrates the relative influence that a total differential, a coefficient of friction (COF), an oil absorption rate, a spin time, a radius of gyration, a ratio of differentials, an intermediate differential (Int. Diff.), and a coverstock type have on the motion of the bowling ball 20. The analysis shows that the COF, oil absorption rate, and radius of gyration have the greatest influence on the motion of the bowling ball 20. Physical characteristics such as coverstock type and ratio of differentials have a proportionately small influence on the motion of the bowling ball 20.

Figure 6:
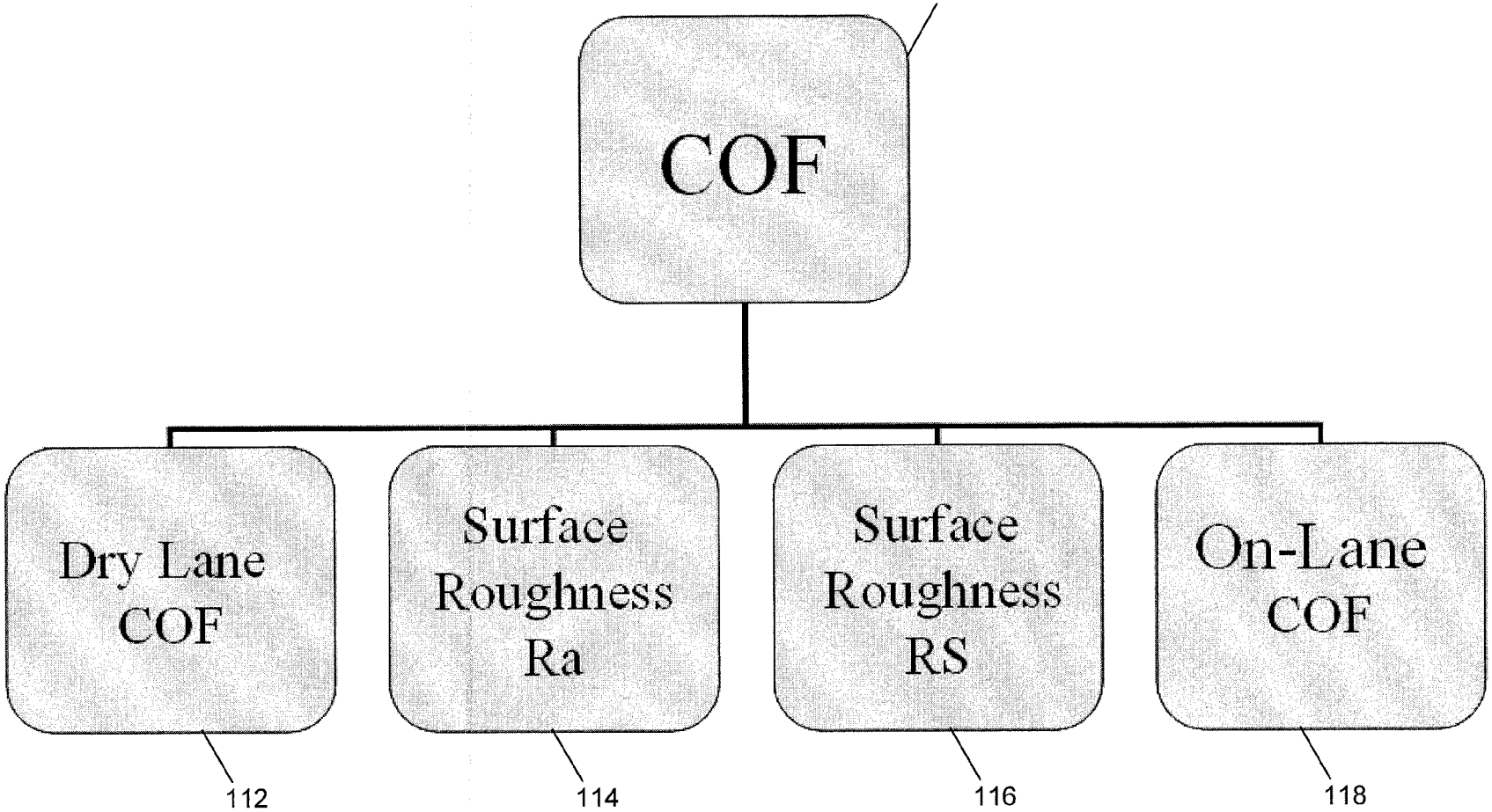
FIGS. 6-8 illustrate independent variables represented by a subset of one or more additional independent variables.
Figure 8:
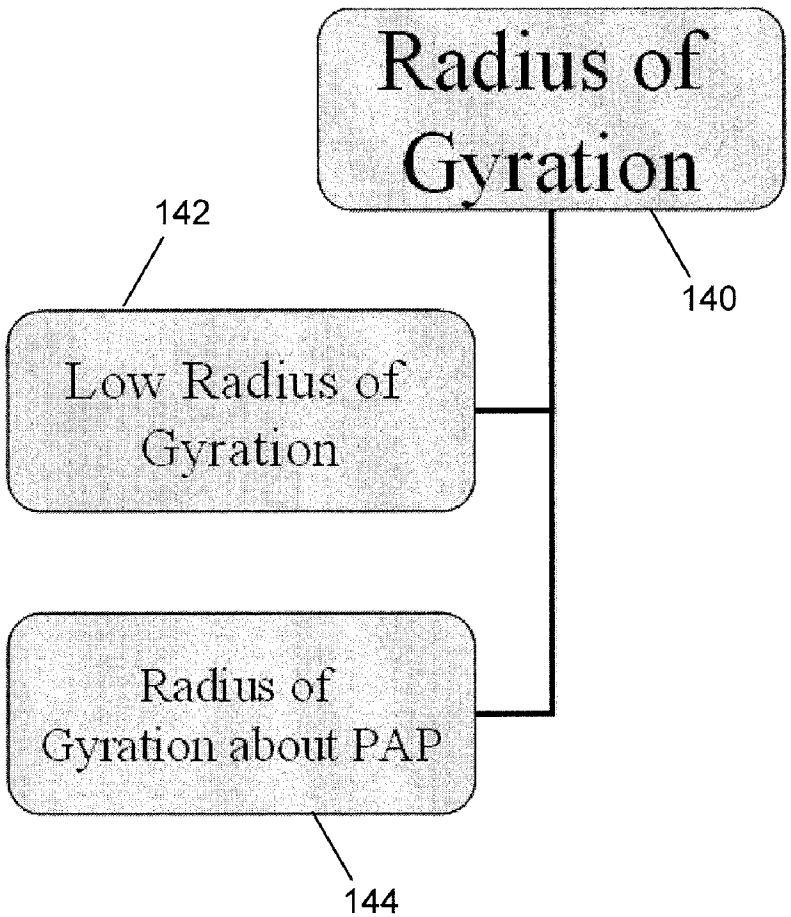
Figure 7:
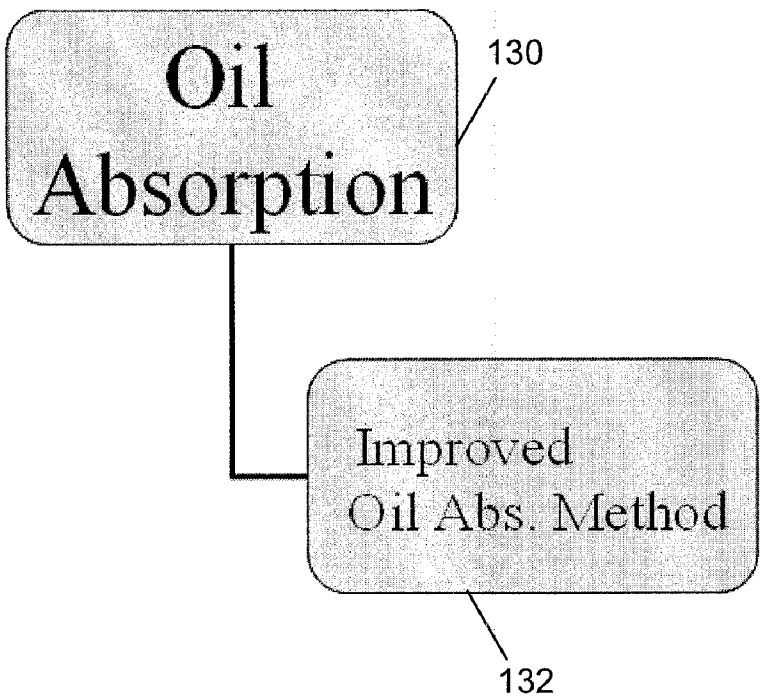

In embodiments of the invention, physical characteristics such as COF and radius of gyration can be represented as single measured physical characteristic or as multiple measured physical characteristics that influence the motion of the bowling ball 20, as shown in FIGS. 6-8. For example, FIG. 6 illustrates the COF 110 as a dry-lane coefficient of friction 112, a surface roughness-RA 114, a surface roughness RS 116, and an on-lane coefficient of friction 118. FIG. 7 illustrates the oil absorption rate 130 as the improved method 132 for determining the oil absorption rate described above. In other embodiments, different methods for determining oil absorption rates are used. The radius of gyration 140 is represented in FIG. 8 as a low radius of gyration 142 and a radius of gyration about a positive point axis 144.

Figure 9:
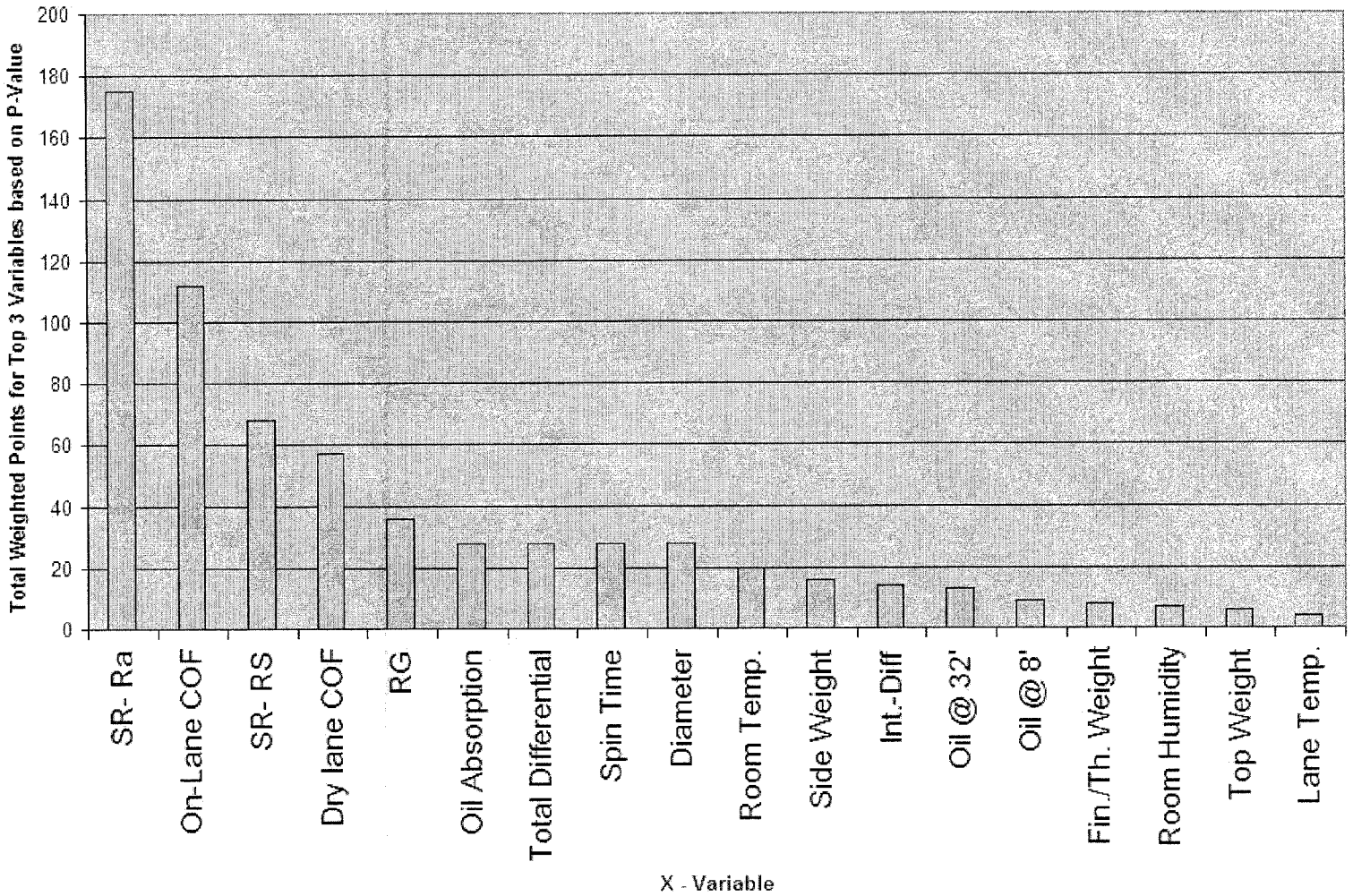
FIG. 9 illustrates a relative influence that each physical characteristic in a set of physical characteristics has on the motion of a bowling ball based on a 3-point weighted scale.
Figure 10:
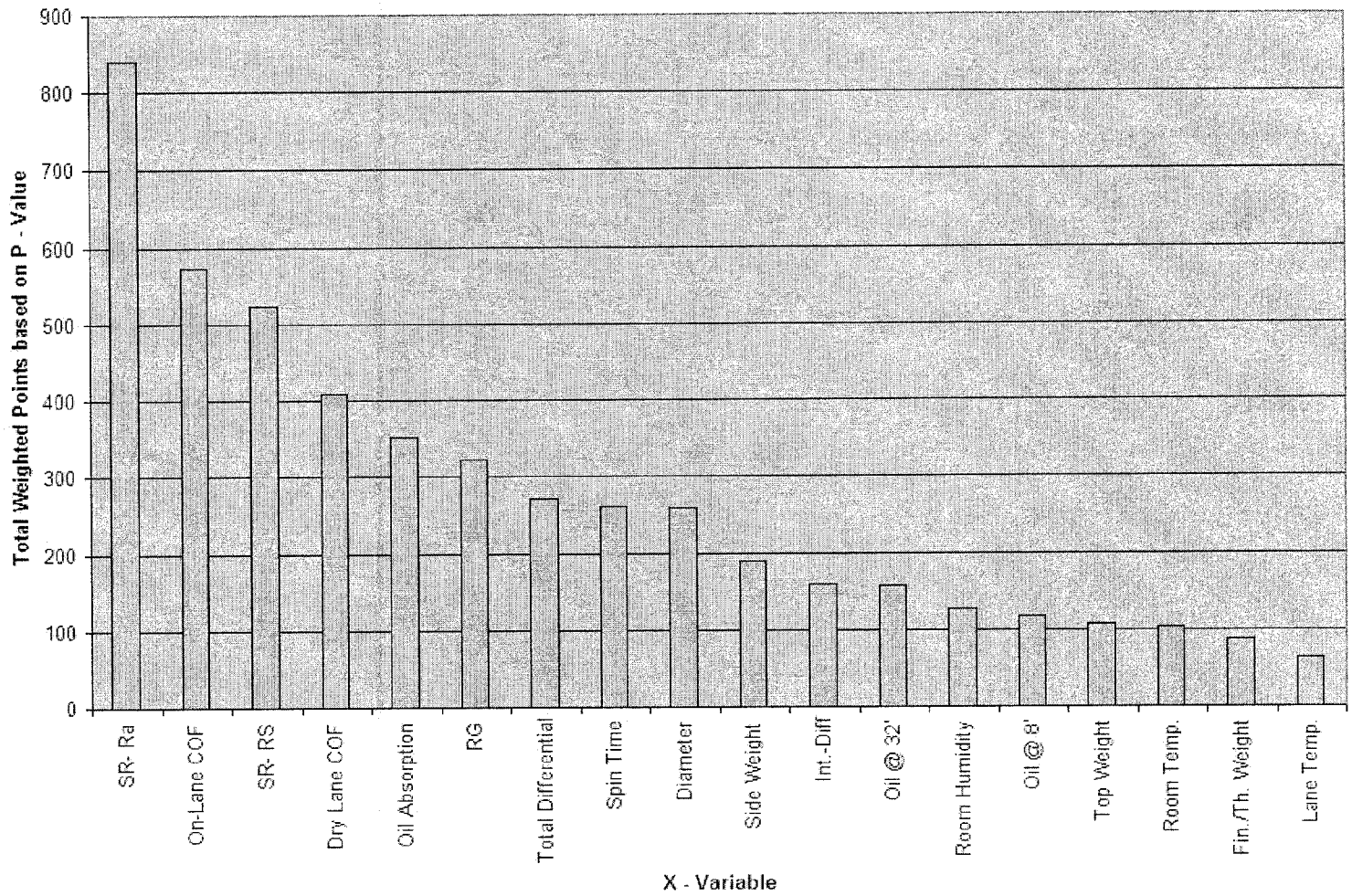
FIG. 10 illustrates the effect that each physical characteristic in a set of physical characteristics has on the motion of a bowling ball based on an 18-point weighted scale.

FIGS. 9 and 10 illustrate the relative influence that each of the physical characteristics has on the motion of the bowling ball 20. Unlike FIG. 5, FIGS. 9 and 10 include eighteen physical characteristics. FIG. 9 shows a table 150 that illustrates the relative influence that each physical characteristic has on the motion of the bowling ball 20 based on a three point weighted scale. FIG. 10 shows a table 160 that illustrates the relative influence that each physical characteristic has on the motion of the bowling ball 20 based on an 18 point weighted scale. The physical characteristics with the greatest influence on the motion of the bowling ball 20 are assigned the most points. For example, the physical characteristic with the greatest influence on the bowling ball 20's motion receive 3 points or 18 points depending on the scale used. The 3 point and 18 point weighted scales are selected for convenience. In other embodiments, different weighted scales are used. Additionally, the six most significant physical characteristics related to bowling ball motion have been found to be the Surface Roughness-Ra, On-Lane Coefficient of Friction, Surface Roughness-RS, Dry-Lane Coefficient of Friction, Oil Absorption, and Radius of Gyration. In some embodiments of the invention, additional independent and dependent variables are included in the analysis of the bowling ball 20 and the independent variables with the greatest influence on the bowling ball's 20 path are different.

FIG. 11 shows a table 170 that provides prediction results according to an embodiment of the invention. Predictions are calculated for two bowling balls (WB1 and EB2). Based on the calculated ball-motion equations and the relative influence that each physical characteristic has on the motion of the bowling ball 20, it was found that embodiments of the invention predict 80% of the dynamic attributes within a ±5% interval. Each of the predicted dynamic attributes for the EB2 bowling ball is within a ±5% interval, and five of eight predicted dynamic attributes are within the ±5% interval for the WB1 bowling ball.

Various features and embodiments of the invention are set forth in the following claims.

What is claimed is:

1. A method for analyzing and predicting a path of a bowling ball, the method comprising:

determining a plurality of physical characteristics of a first bowling ball, the plurality of physical characteristics including a ball surface roughness, lane coefficient of friction, an oil absorption rate, and a radius of gyration;

determining a plurality of dynamic attributes of the first bowling ball by repeatedly throwing the first bowling ball down a bowling lane, and monitoring the motion of the first bowling ball during each throw using a plurality of sensors, the monitoring including monitoring a skid phase, a hook phase, and a back-end phase of the first bowling ball, and determining a path of motion, spin rate, and velocity of the first bowling ball as it travels down the bowling lane;

determining a relationship between the plurality of physical characteristics of the first bowling ball and the plurality of dynamic attributes of the first bowling ball using a multivariable regression;

determining a plurality of physical characteristics of a second bowing ball; and accepting, by a computer the plurality of physical characteristics of the second bowling ball and executing, with a computer a program based on the relationship and to generate a predicted path of the second bowling ball based on the plurality of physical characteristics of the second bowling ball.

2. A method as claimed in claim 1, wherein the monitoring further comprises:

determining the first bowling ball's intended path at a first distance and at a second distance.

3. A method as claimed in claim 2, wherein the monitoring further comprises:

determining the first bowling ball's average path at the first distance and at the second distance.

4. A method as claimed in claim 3, wherein the monitoring further comprises:

determining the first bowling ball's decrease in velocity between a third distance and the first distance; and determining the first bowling ball's decrease in velocity between the third distance and the second distance.

5. A method as claimed in claim 2, wherein the monitoring further comprises determining the first bowling ball's change of angle at the first distance and at the second distance.

6. A method as claimed in claim 5, wherein the monitoring further comprises determining a first transition point, a second transition point, a negative slope, a positive slope, a total angle, a total hook length, an angle per foot, a breakpoint, a first transition to breakpoint length, a breakpoint to second transition length, and a frictional efficiency.

7. A method as claimed in claim 1, wherein repeatedly throwing the first bowling ball down a bowling lane is accomplished using an automatic ball thrower.

8. A method as claimed in claim 7, further comprising configuring the automatic ball thrower to throw a bowling ball a number of times with consistent rotational speed, rotational axis, angle of delivery, loft, and velocity.

9. A system for predicting a path of a first bowling ball, the system comprising:

a computer that accepts a plurality of physical characteristics of the first bowling ball and executes a program based on a predetermined relationship and generates a predicted path of the first bowling ball based on the plurality of physical characteristics of the first bowling ball;

wherein the predetermined relationship is based on a regression analysis of a plurality of physical characteristics of a second bowling ball and a plurality of dynamic attributes of the second bowling ball, the plurality of physical characteristics of the second bowling ball including a ball surface roughness, lane coefficient of friction, an oil absorption rate, and a radius of gyration;

the plurality of dynamic attributes of the second bowling ball determined by repeatedly throwing the second bowling ball down a bowling lane using an automatic ball thrower, and monitoring the motion of the second bowling ball during each throw using a plurality of sensors, the monitoring including monitoring a skid phase, a hook phase, and a back-end phase of the second bowling ball and determining a path of motion, spin rate, and velocity of the second bowling ball as it travels down the bowling lane.

10. A system as claimed in claim 9, further comprising a computer aided tracking device; and wherein the automatic ball thrower is a robotic ball thrower.

11. A system as claimed in claim 10, wherein the robotic ball thrower is configured to throw the first bowling ball in a repeatable manner, with consistent rotational speed, rotational axis, angle of delivery, loft, and velocity.

12. A system as claimed in claim 10, wherein the computer aided tracking device comprises a bowling lane and a number of sensors.

13. A system as claimed in claim 10, wherein the computer aided tracking device is configured to determine the second bowling ball's path, spin rate, velocity, launch angle, and entry angle for each throw; and determine an average bowling ball path, average velocity at a number of points along the average bowling ball path, average launch angle, and average entry angle, for a number of throws of the second bowling ball.

14. A method for analyzing and predicting the path of a bowling ball that is thrown down a bowling lane, the method comprising:

determining physical characteristics of a bowling ball, the physical characteristics including an oil absorption rate, a surface roughness, and a finger/thumb weight;

generating a first set of data comprised of the physical characteristics of the bowling ball;

throwing the bowling ball down the bowling lane a number of times;

determining dynamic attributes of the bowling ball as it travels down the lane using a number of sensors;

generating a second set of data based upon the characteristics of the bowling ball's path;

determining a relationship between the first set of data and the second set of data; and using the relationship to predict a path of a second bowling ball.

15. A method as claimed in claim 14, wherein an automatic precision ball thrower is used to throw the bowling ball down the lane in a repeatable manner.

16. A method as claimed in claim 15, wherein the automatic precision ball thrower is configured to throw the bowling ball a number of times with consistent rotational speed, rotational axis, angle of delivery, loft, and velocity.

17. A method as claimed in claim 14, wherein the first set of data includes an on-lane coefficient of friction, a dry lane coefficient of friction, a radius of gyration, a total differential, an intermediate differential, a spin time, a diameter, a room temperature, a side weight, an oil volume at 8 feet and 32 feet, a room humidity, a top weight, and a lane temperature.

18. A method as claimed in claim 14, wherein the second set of data includes the bowling ball's intended path at a first distance, intended path at a second distance, average path at the first distance, and average path at the second distance.

19. A method as claimed in claim 14, wherein the second set of data includes the bowling ball's decrease in velocity between a third distance and a first distance and decrease in velocity between the third distance and a second distance.

20. A method as claimed in claim 14, wherein the second set of data includes the bowling ball's change of angle at a first distance, change of angle at a second distance, an angle per foot, and a total angle.

21. A method as claimed in claim 14, wherein the second set of data includes a first transition point, a second transition point, a breakpoint, a first transition to breakpoint length, and a breakpoint to second transition length.

22. A method as claimed in claim 14, wherein the second set of data includes a negative slope, a positive slope, a total hook length, and a frictional efficiency.

23. A method as claimed in claim 14, wherein a computing device uses multivariable regression analysis, with the first set of data as the independent variables and the second set of data as the dependent variables, to determine the relationship between the first set of data and the second set of data.

24. A computer system for predicting motion of a test bowling ball, the system comprising:

a programmed processor configured to receive input data regarding physical characteristics of the test bowling ball, the physical characteristics including surface roughness, lane coefficient of friction, an oil absorption rate, and a radius of gyration, the programmed processor including a path predicting module configured to generate a predicted path of the test bowling ball based on a relationship between:

a predetermined plurality of dynamic attributes of one or more second bowling balls which are not the test bowling ball, and a predetermined plurality of physical characteristics of the one or more second bowling balls which are not the test bowling ball, the predetermined plurality of physical characteristics including an oil absorption rate, a surface roughness, and a finger/thumb weight; and;

wherein the relationship is a based on a regression analysis and is stored in a memory accessible by the programmed processor.

25. The system as claimed in claim 24, wherein the physical characteristics further include an on-lane coefficient of friction, a dry lane coefficient of friction, a radius of gyration, a total differential, an intermediate differential, a spin time, a diameter, a room temperature, a side weight, an oil volume at 8 feet and 32 feet, a room humidity, a top weight, and a lane temperature.

26. A system as claimed in claim 24, wherein the dynamic attributes of the second bowling ball include an average bowling ball path, average velocity at a number of points along the average bowling ball path, average launch angle, and average entry angle.

* * * * *